US009222678B2

(12) United States Patent
Venkatakrishnan

(10) Patent No.: US 9,222,678 B2
(45) Date of Patent: Dec. 29, 2015

(54) REDUCING PRE-HEAT TIME IN AN OVEN

(71) Applicant: General Electric Company, Schenectady, NY (US)

(72) Inventor: Natarajan Venkatakrishnan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 345 days.

(21) Appl. No.: 13/775,390

(22) Filed: Feb. 25, 2013

(65) Prior Publication Data

US 2014/0238382 A1 Aug. 28, 2014

(51) Int. Cl.

| | |
|---|---|
| ***F24C 11/00*** | (2006.01) |
| ***F24C 15/32*** | (2006.01) |
| ***F24C 15/34*** | (2006.01) |

(52) U.S. Cl.

CPC ..... *F24C 11/00* (2013.01); *F24C 15/32* (2013.01); *F24C 15/34* (2013.01)

(58) Field of Classification Search

CPC ..... F24C 15/34; F24C 11/00; F24C 15/32; F24C 15/327

See application file for complete search history.

(56) References Cited

U.S. PATENT DOCUMENTS

| | | | |
|---|---|---|---|
| 1,815,115 | A | 7/1931 | Pfeiffer |
| 2,113,996 | A | 4/1938 | Spiess |
| 5,696,872 | A | 12/1997 | Seward |
| 6,388,285 | B1 | 5/2002 | Black et al. |
| 6,627,106 | B1 | 9/2003 | Lotz et al. |
| 6,756,570 | B2 | 6/2004 | Sauter |
| 8,049,142 | B2 | 11/2011 | Blackson et al. |
| 2008/0184986 | A1 | 8/2008 | Kohlstrung |
| 2010/0089556 | A1 | 4/2010 | Yang |

FOREIGN PATENT DOCUMENTS

| | | | |
|---|---|---|---|
| BE | 432660 | A | 3/1939 |
| DE | 618755 | C | 9/1935 |
| EP | 1087003 | A2 | 3/2001 |
| EP | 1757861 | A1 | 2/2007 |
| WO | 2006029597 | A1 | 3/2006 |

OTHER PUBLICATIONS

International Search Report and Written Opinion issued in connection with corresponding PCT Application No. PCT/US2014/013097 dated Nov. 13, 2014.

*Primary Examiner* — Alfred Basichas

(74) *Attorney, Agent, or Firm* — Dority & Manning, P.A.

(57) ABSTRACT

A heating assembly is provided to reduce the pre-heat time of an oven. The heating assembly vaporizes a phase change fluid in an evaporator, allows the phase change fluid vapor to travel to a reactor in thermal communication with a cooking chamber of an oven appliance. In the reactor, the phase change fluid combines with a reaction substance and condenses, releasing latent heat and providing heat to the cooking chamber of the oven appliance.

18 Claims, 4 Drawing Sheets

REDUCING PRE-HEAT TIME IN AN OVEN

FIELD OF THE INVENTION

The present disclosure relates generally to an oven appliance, or more specifically, to an apparatus and method for reducing the pre-heat time in an oven appliance.

BACKGROUND OF THE INVENTION

Conventional residential and commercial oven appliances generally include a cabinet that defines a cooking chamber for receipt of food items for cooking. Heating elements are positioned within the cooking chamber to provide heat to food items located therein. The heating elements can include radiant heating elements, such as a bake heating element positioned at a bottom of the cooking chamber and/or a broil heating element positioned at a top of the cooking chamber.

Generally, oven appliances are preheated prior to inserting food items into the appliance's cooking chamber. Such preheating can be necessary to heat the oven appliance's walls, doors, and other exposed surfaces and bring the temperature of the oven appliance up to a steady-state operating temperature. Prior to such pre-heating, radiant heat transfer from such components can be insufficient or unsuitable to properly cook food items within the cooking chamber. Generally, oven appliances activate the broil heating element and the bake heating element during the pre-heat cycle. In particular, the broil heating element and the bake heating element are generally operated at a single constant power output during the pre-heat cycle until the steady-state operating temperature is obtained. During such pre-heating cycles, any food items placed in the cooking chamber may not cook properly because the amount of heat provided to the food items and the exposure to radiant heat from the broil heating element does not match that of a pre-heated (steady-state) oven. For example, the top portion of the food items may cook more quickly than the bottom portion of the food items due to the activated broil heating element.

To avoid such heat imbalance, a user must generally wait for the cooking chamber to reach the steady-state cooking temperature before inserting food items therein. However, waiting for the oven to pre-heat can consume a significant amount of the user's time. For example, pre-heat cycles can take over ten minutes to complete depending upon the operating temperature desired.

Accordingly, an apparatus or method for decreasing the pre-heat time of an oven appliance would be particularly beneficial.

BRIEF DESCRIPTION OF THE INVENTION

The present disclosure provides a heating assembly to reduce the pre-heat time of an oven. The heating assembly vaporizes a phase change fluid in an evaporator, allows the phase change fluid vapor to travel to a reactor in thermal communication with a cooking chamber of an oven appliance. In the reactor, the phase change fluid combines with a reaction substance and condenses, releasing latent heat and heating the cooking chamber of the oven appliance. Additional aspects and advantages of the disclosure will be set forth in part in the following description, or may be apparent from the description, or may be learned through practice of the disclosure.

In one exemplary embodiment of the present disclosure, an oven appliance is provided. The oven appliance includes a cooking chamber and a heating assembly. The heating assembly includes an evaporator and a reactor in thermal communication with the cooking chamber and in fluid communication with the evaporator. A phase change fluid is contained within the evaporator, the reactor, or both. A reaction substance is positioned within the reactor and is configured for dissolving in the phase change fluid when present in the reactor. A valve is in fluid communication with the evaporator and the reactor. The valve is selectively positionable between an open position and a closed position whereby the flow of phase change fluid between the reactor and the evaporator may be selectively controlled.

In one exemplary aspect of the present disclosure, a method for providing heat to a cooking chamber of an oven appliance is provided. The appliance has a reactor in thermal communication with the cooking chamber, an evaporator, and a valve in fluid communication with the reactor and the evaporator. The method includes the steps of moving the valve to an open position; vaporizing a portion of a phase change fluid contained within the evaporator such that it travels through the valve to the reactor; condensing a portion of the phase change fluid in the reactor; and transferring heat to the cooking chamber of the oven from the reactor during the step of condensing.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION OF THE INVENTION

Figure 1:
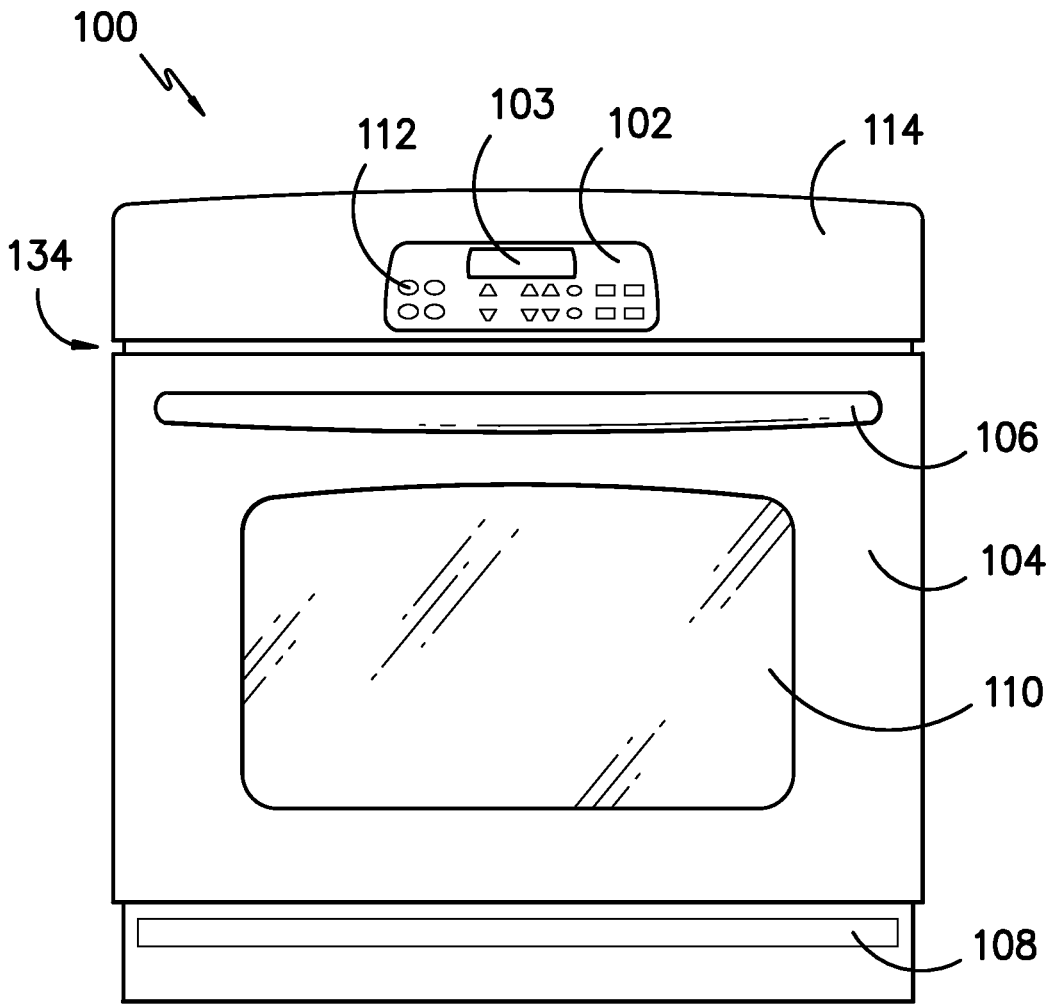
FIG. 1 provides a front view of an exemplary embodiment of an oven appliance of the present disclosure.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

Figure 2:
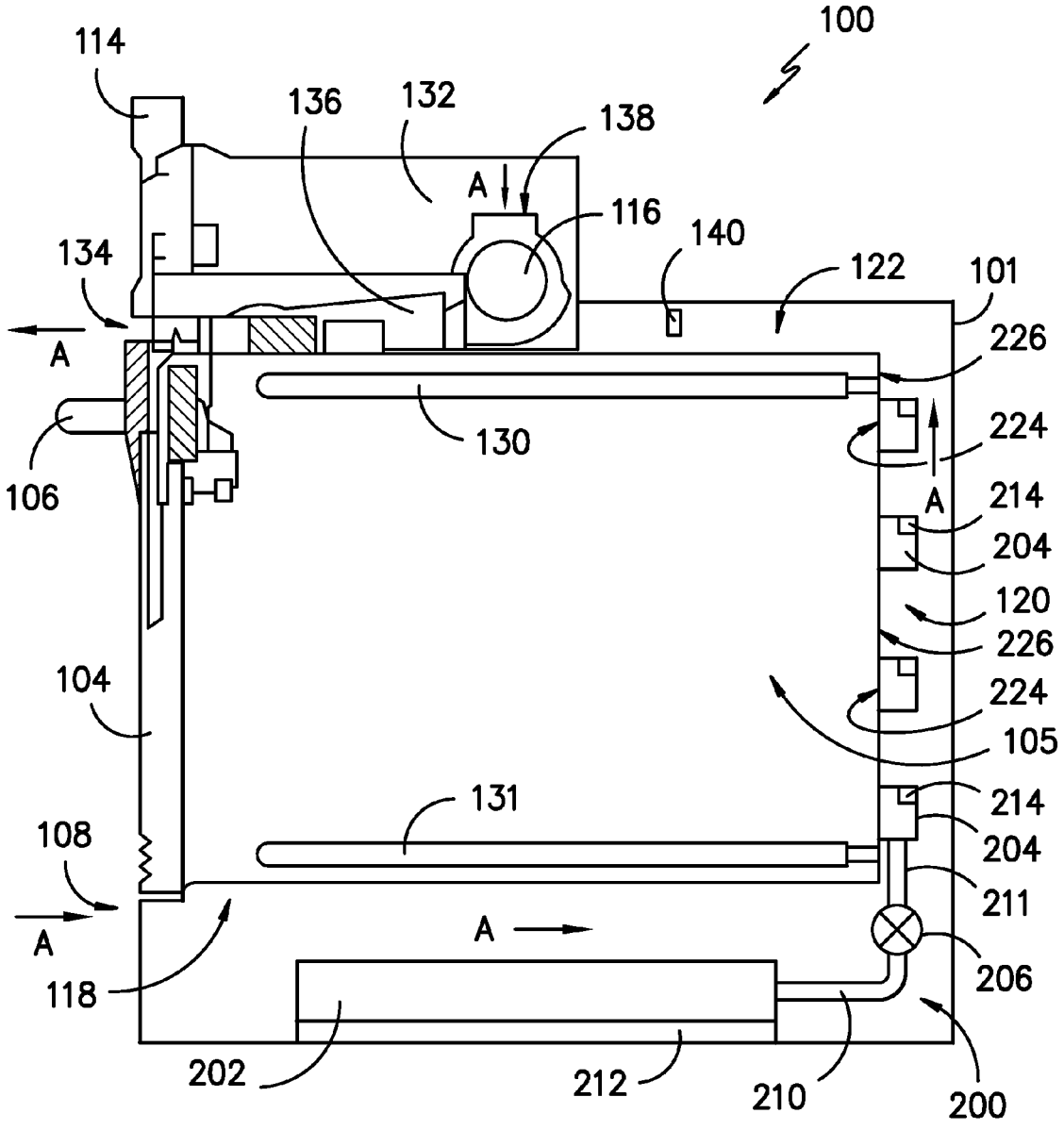
FIGS. 2 and 3 provide cross-sectional a side view and front view, respectively, of the oven appliance of FIG. 1.
Figure 3:
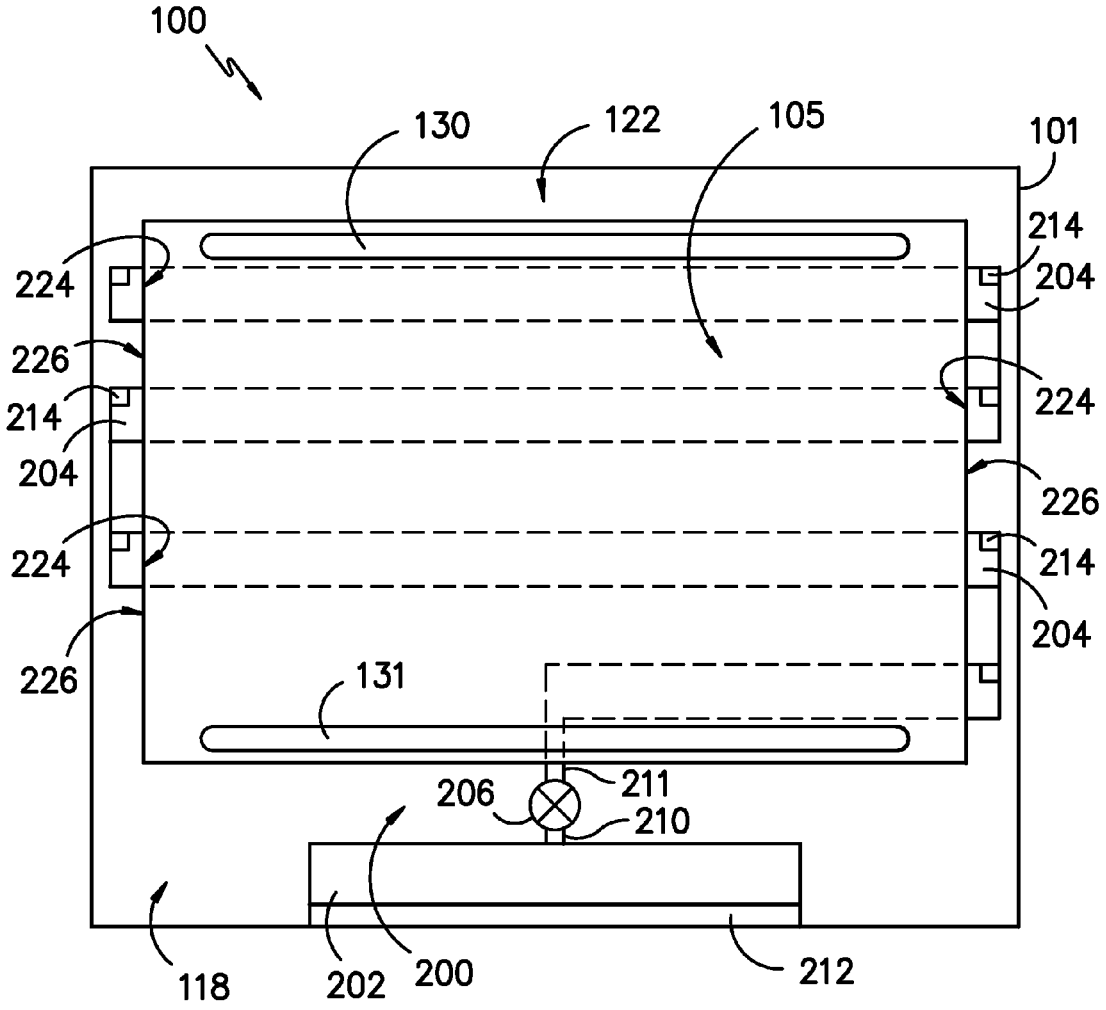

Referring to FIGS. 1 through 3, an exemplary embodiment of an oven appliance 100 according to the present disclosure is shown. FIG. 1 provides a front view of oven 100 while FIGS. 2 and 3 provide a cross-sectional side view and a cross-sectional front view, respectively. Oven 100 includes a door 104 with a handle 106 that provides for opening and closing access to a cooking chamber 105. A user of the oven 100 can place a variety of different items to be cooked in chamber 105. Heating elements 130 and 131 are positioned at the top of chamber 105 and the bottom of chamber 105, respectively, and provide heat for cooking. Heating elements 130, 131 can be gas, electric, microwave, or a combination thereof. Racks (not shown) in chamber 105 can be used to place food items at various levels for cooking. A window 110 on door 104 allows the user to view e.g., food items during the cooking process.

Oven 100 includes a user interface 102 having a display 103 positioned on a top panel 114 with a variety of controls 112. Interface 102 allows the user to select various options for the operation of oven 100 including e.g., temperature, time, and/or various cooking and cleaning cycles. Operation of oven appliance 100 can be regulated by a controller (not shown) that is operatively coupled i.e., in communication with, user interface panel 102, heating elements 130 and 131, a heating assembly 200 (discussed below), and other components of oven 100 as will be further described.

For example, in response to user manipulation of the user interface panel 102, the controller can operate heating elements 130 and 131. The controller can receive measurements from a temperature sensor (not shown) placed in cooking chamber 105 and e.g., provide a temperature indication to the user with display 103. The controller can also be provided with other features as will be further described herein.

By way of example, the controller may include a memory and one or more processing devices such as microprocessors, CPUs or the like, such as general or special purpose microprocessors operable to execute programming instructions or micro-control code associated with operation of appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout appliance 100. In the illustrated embodiment, the controller may be located under or next to the user interface 102, or otherwise within top panel 114. In such an embodiment, input/output ("I/O") signals are routed between the controller and various operational components of appliance 100, such as heating elements 130, 131, controls 112, display 103, sensor(s), alarms, and/or other components as may be provided. In one embodiment, the user interface panel 102 may represent a general purpose I/O ("GPIO") device or functional block.

Although shown with touch type controls 112, it should be understood that controls 112 and the configuration of appliance 100 shown in FIGS. 1 through 3 are provided by way of example only. More specifically, user interface 102 may include various input components, such as one or more of a variety of electrical, mechanical or electro-mechanical input devices including rotary dials, push buttons, and touch pads. The user interface 102 may include other display components, such as a digital or analog display device designed to provide operational feedback to a user. The user interface 102 may be in communication with the controller via one or more signal lines or shared communication busses. Also, oven 100 is shown as a wall oven but the present disclosure could also be used with other appliances such as e.g., a stand-alone oven, an oven with a stove-top, and other configurations as well.

During operation of oven 100 in both cooking and cleaning cycles, the temperatures that are needed in chamber 105 can be high. As such, oven 100 is provided with a ventilation system whereby ambient air is used to help cool appliance 100. More specifically, oven 100 includes air passageways 118, 120, and 122 located within the bottom, rear, and top of the cabinet 101 of oven 100. During operation of the ventilation system, a blower or fan 116 located in electronics bay cavity 132 moves heated air into its inlet 138. This air is forced through duct 136 and exits oven 100 through vent 134 located between door 104 and top panel 114. Fan 116 moves air from the electronics bay cavity 132, which is connected with air passageways 118, 120, 122. Cooler air from the ambient is moved into air passageway 118 through air inlet 108, which is located below door 104. The flow of air is indicated by arrows A in FIG. 2.

The ventilation system is selectively operable, such that the controller can turn on and off fan 116 during certain operating times of oven 100. For example, the controller may turn off fan 116 while oven 100 is pre-heating, so as to reduce the pre-heat time of cooking chamber 105 of oven 100. When ventilation system is operating, however, an air flow measuring device 140 is provided to ensure that proper ventilation occurs. Measuring device 140 is positioned within air passageway 122 for this exemplary embodiment.

It should be appreciated that the ventilation system described for oven 100 is provided by way of example only. As will be understood by one of skill in the art using the teachings disclosed herein, numerous other configurations may be used as well. By way of example, the flow of air could be reversed by changing the direction of operation of fan 116, or device 140 could be placed in any other location proximate to air flow A.

As stated, users of oven 100 generally wait for cooking chamber 105 of oven 100 to reach a steady-state operating temperature, or pre-heat, prior to inserting food to be cooked. In order to reduce the amount of time it takes for cooking chamber 105 of oven 100 to pre-heat, heating assembly 200 is provided.

Referring now to the exemplary embodiment of oven 100 provided in FIGS. 2 and 3, heating assembly 200 includes an evaporator 202 positioned below cooking chamber 105 in air passageway 118. Evaporator 202 is in fluid communication with a valve 206 by way of a conduit 210. Further, heating system 200 includes one or more reactors 204 also in fluid communication with valve 206 by way of a conduit 211 and connected with each other as well by e.g., conduit (not shown).

Valve 206 is selectively moveable between an open position and a closed position. When valve 206 is in the open position, evaporator 202 is in fluid communication with reactor 204. When valve 206 is in the closed position, evaporator 202 is shut-off from reactor 204. The controller in oven appliance 100 can be configured to move valve 206 to the open position and to the closed position based on various methods of operation as discussed below.

Reactor 204 wraps around cooking chamber 105 and includes a flat surface 224 which contacts an outer surface 226 of cooking chamber 105. This configuration allows reactor 204 to be in thermal communication with cooking chamber 105 such that heat from reactor 204 may be transferred to cooking chamber 105 and heat from cooking chamber 105 may be transferred to reactor 204. Additionally, an auxiliary heater 212 is optionally included for this exemplary embodiment to provide additional heat to evaporator 202 during certain operating conditions of heating assembly 200 as will be discussed below.

Positioned within reactor 204 is a reaction substance such as a salt, which can be dispersed within a metallic matrix 214 located within reactor 204. Heating assembly 200 also includes a solvent or phase change fluid that is contained within evaporator 202, reactor 204, or both. By way of example, the reaction substance can be a halide compound such as lithium bromide and the phase change can be water. However, other reaction substances and phase change fluids may be used as well. For example, other salt compositions suitable for use in absorption heat cycles may also be used. The phase change fluid may be any other organic or inorganic fluid suitable for use in absorption heat cycles, such as e.g., methanol.

Evaporator 202 and reactor 204 may be positioned in a variety of locations throughout oven appliance 100 and may have other configurations suitable for transferring heat to cooking chamber 105—it being understood that the embodiment shown in the figures is provided by way of example only. For instance, evaporator 202 could be positioned behind cooking chamber 105, and cooking chamber 105 can be provided with a plurality of grooves, wherein reactor 204 fits into the plurality of grooves.

As is explained below with reference to FIGS. 4 and 5, heating assembly 200 uses an absorption heat cycle to provide energy in the form of heat to cooking chamber 105 during a heating cycle, and to collect and store energy during a charging cycle. The heating cycle is explained below with reference to FIG. 4 and the charging cycle is discussed below with reference to FIG. 5.

Figure 4:
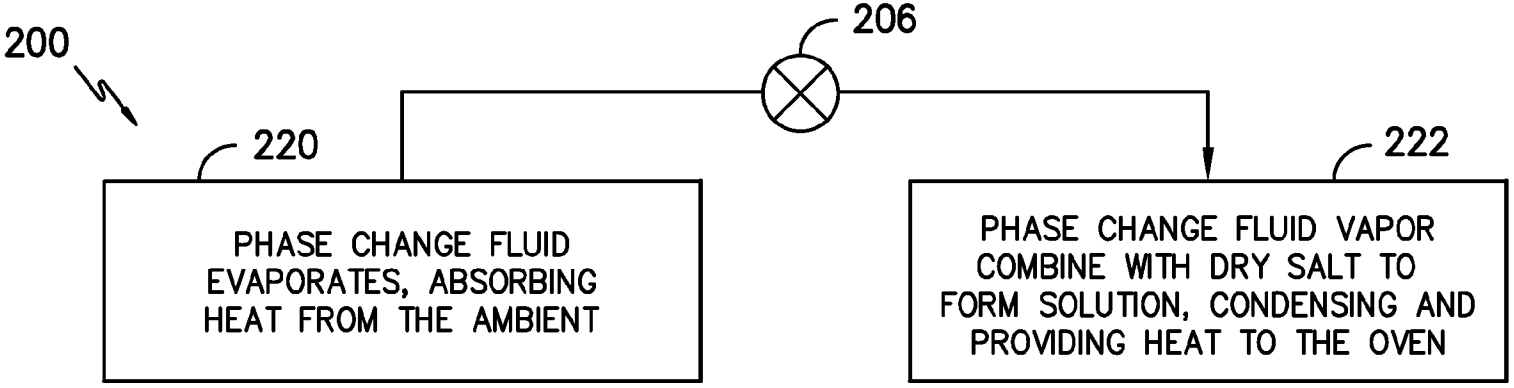
FIGS. 4 and 5 provide schematic illustrations of exemplary embodiments of a heating cycle of a heating assembly of the present disclosure.

Referring to the heating cycle provided in FIG. 4, the phase change fluid starts off in liquid form in evaporator 202 with valve 206 in the closed position. The pressures in evaporator 202 and in reactor 204 are lower than vapor pressure of the phase change fluid. As such, when valve 206 opens in step 220, a portion of the phase change fluid vaporizes as it absorbs heat from the ambient, heat provided by operation of oven 100, and/or heat provided by auxiliary heater 212.

Vaporized phase change fluid then travels through valve 206 and into reactor 204. In step 222, the vaporized phase change fluid combines with the reaction substance present in reactor 204, causing the phase change fluid to condense in reactor 204 and form a solution. This process of condensing releases latent heat and provides heat to reactor 204. The heat may then transfer from reactor 204 to cooking chamber 105.

The heating cycle shown in FIG. 4 continues until all or some portion of the phase change fluid vaporizes in evaporator 202, travels to reactor 204, combines with the reaction substance, condenses, and provides heat to reactor 204. As previously discussed, auxiliary heater 212, shown in FIGS. 2 and 3, may provide additional heat to evaporator 202 to assist in vaporizing the phase change fluid in evaporator 202 during step 220. Once substantially all or some portion of the phase change fluid has vaporized and traveled from evaporator 202 to reactor 204, valve 206 is moved to the closed position by e.g., commands from a controller. It should be appreciated, however, that in other exemplary embodiments, valve 206 may not be configured to close once substantially all the phase change fluid has vaporized and traveled from evaporator 202 to reactor 204. For example, valve 206 may be configured to close before all fluid has vaporized if the desired temperature for cooking operations has already been reached in chamber 105. By way of still further example, heating assembly 200 may leave valve 206 open and begin a charging cycle, as discussed below with reference to FIG. 5.

Figure 5:
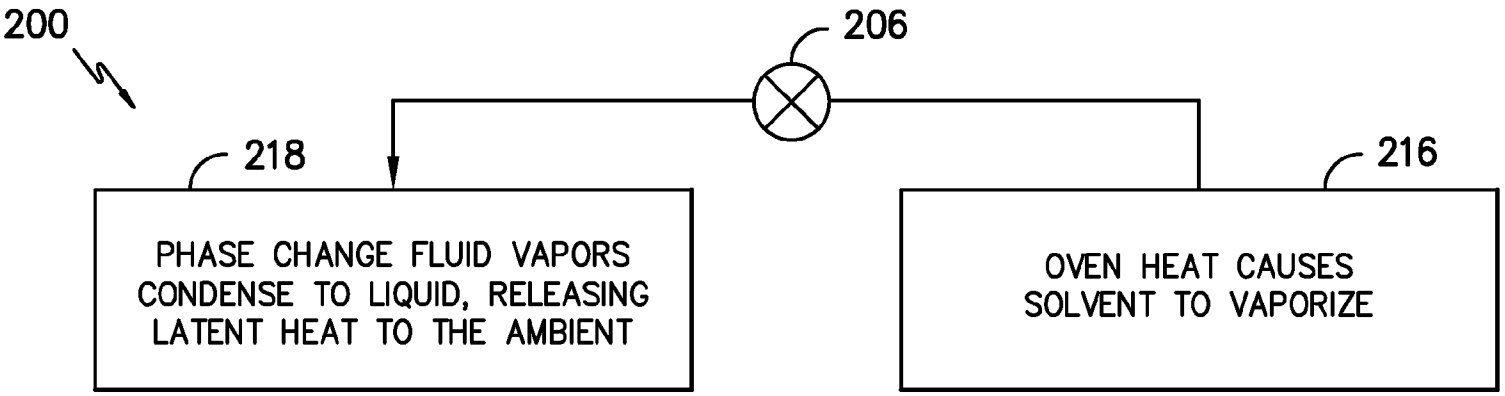

When the phase change fluid present in reactor 204 of heating assembly 200 is not being used to provide heat to cooking chamber 105, heating assembly 200 may commence a charging cycle as provided in FIG. 5. The charging cycle may take place at any time wherein the temperature in the cooking compartment is elevated to a required temperature. For example, the charging cycle may take place after a heating cycle is completed (as discussed above with reference to FIG. 4), after the cooking chamber reaches a steady-state temperature, after the user is done cooking in cooking chamber 105, and/or during a special oven heating cycle.

As shown in step 216 of FIG. 5, during the charging cycle, a portion of the phase change fluid is vaporized in reactor 204 using heat transferred from cooking chamber 105 to reactor 204. The vaporization process of step 216 absorbs heat from the ambient and cooking chamber 105. During this step, valve 206 is placed into the open position and the vaporized portion of phase change fluid separates from the reaction substance and travels from reactor 204, through valve 206, and into evaporator 202. The increased temperature of reactor 204 correspondingly increases the pressure in reactor 204, which helps drive the vaporized phase change fluid into evaporator 202.

In step 218, the portion of vaporized phase change fluid from reactor 204 condenses in evaporator 202 thereby releasing latent heat to the ambient. Once substantially all or some portion of the phase change fluid and reaction substance solution has vaporized in reactor 204, traveled to evaporator 202, and condensed in evaporator 202, valve 206 is configured to move to the closed position. Reactor 204 and cooking chamber 105 can then cool and, after a period of time, the pressure in reactor 204 will correspondingly decrease. At this point, heating assembly 200 is charged and ready to start a heating cycle as provided in FIG. 4 when desired.

As noted, heating assembly 200 may be controlled by the controller of oven appliance 100. As such, heating assembly 200 may contain sensors (not shown) operatively coupled to the controller that indicate certain operating conditions of heating assembly 200. For example, heating assembly may include pressure sensor(s), temperature sensor(s), valve 206 position sensor(s), reaction substance sensor(s), and/or phase change fluid sensor(s). Further, the controller may utilize one or more of these sensors when making control decisions. As discussed above, for example, controller may be configured to close valve 206 based on the amount of phase change fluid in evaporator 202 or reactor 206, or based on the temperature of evaporator 202 or reactor 206.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising:

a cooking chamber; and a heating assembly, comprising an evaporator, a reactor in thermal communication with said cooking chamber and in fluid communication with said evaporator, a phase change fluid contained within said evaporator, said reactor, or both, a reaction substance located within said reactor and configured for dissolving in the phase change fluid when present in the reactor;

a valve in fluid communication with said evaporator and said reactor, said valve selectively positionable between an open position and a closed position whereby the flow of phase change fluid between said reactor and said evaporator may be selectively controlled.

2. An oven appliance as in claim 1, wherein said phase change fluid comprises water, methanol, or a combination thereof.

3. An oven appliance as in claim 1, wherein said phase change fluid comprises an organic liquid, an inorganic liquid, or a combination thereof.

4. An oven appliance as in claim 1, wherein said reaction substance comprises a Halide Compound.

5. An oven appliance as in claim 1, wherein said phase change fluid is contained in said evaporator at a pressure lower than vapor pressure of the phase change fluid such that when said valve is moved to the open position, at least a portion of said phase change fluid vaporizes and travels through said valve to said reactor.

6. An oven appliance as in claim 1, wherein a portion of said phase change fluid is combined with the reaction substance in said reactor.

7. An oven appliance as in claim 1, wherein said valve is configured to close once substantially all of said phase change fluid contained in said evaporator has vaporized and traveled to said reactor.

8. An oven appliance as in claim 1, wherein a portion of said phase change fluid is combined with said reaction substance in liquid form in said reactor to form a solution, and wherein heat from said cooking chamber causes the solution to vaporize, such that a portion of said phase change fluid travels through said valve to said evaporator, leaving the reaction substance in said reactor.

9. An oven appliance as in claim 1, further comprising an auxiliary heater is in thermal communication with said evaporator.

10. An oven appliance as in claim 1, further comprising a metallic matrix on which said reaction substance is dispersed.

11. A method for providing heat to a cooking chamber of an oven appliance, the appliance having a reactor in thermal communication with the cooking chamber, an evaporator, and a valve in fluid communication with the reactor and the evaporator, the method comprising the steps of:

moving the valve to an open position;

vaporizing a portion of a phase change fluid contained within the evaporator such that it travels through the valve to the reactor;

dissolving at least a portion of a reaction substance in the phase change fluid to form a solution in the reactor;

condensing at least a portion of the solution in the reactor; and transferring heat to the cooking chamber of the oven from the reactor during said step of condensing.

12. A method for providing heat to a cooking chamber of an oven as in claim 11, further comprising the step of closing the valve once at least a portion of the phase change fluid contained in the evaporator has vaporized and traveled to the reactor.

13. A method for providing heat to a cooking chamber of an oven as in claim 11, further comprising the step of transferring heat to the reactor from the cooking chamber such that at least a portion of the phase change fluid is vaporized and travels back to the evaporator.

14. A method for providing heat to a cooking chamber of an oven as in claim 13, further comprising the step of leaving the reaction substance in the reactor when the at least a portion of the phase change fluid travels back to the evaporator.

15. A method for providing heat to a cooking chamber of an oven as in claim 14, further comprising the step of closing the valve once at least a portion of the phase change fluid contained in the reactor has vaporized and traveled to the evaporator.

16. A method for providing heat to a cooking chamber of an oven as in claim 11, wherein the reaction substance comprises lithium bromide.

17. A method for providing heat to a cooking chamber of an oven as in claim 11, wherein the phase change fluid comprises methanol, water, or a combination thereof.

18. A method for providing heat to a cooking chamber of an oven as in claim 11, further comprising heating the evaporator using an auxiliary heater in thermal communication with the evaporator.

* * * * *